US010347450B2

(12) United States Patent
Sato et al.

(10) Patent No.: US 10,347,450 B2
(45) Date of Patent: Jul. 9, 2019

(54) THERMALLY ACTUATED SWITCH AND FORMING DIES

(71) Applicant: UBUKATA INDUSTRIES CO., LTD., Nagoya-shi, Aichi (JP)

(72) Inventors: Shigemi Sato, Nagoya (JP); Yuji Adachi, Nagoya (JP)

(73) Assignee: UBUKATA INDUSTRIES CO., LTD, Nagoya-Shi, Aichi (JP)

( * ) Notice: Subject to any disclaimer, the term of this patent is extended or adjusted under 35 U.S.C. 154(b) by 0 days.

(21) Appl. No.: 15/032,243

(22) PCT Filed: Oct. 28, 2013

(86) PCT No.: PCT/JP2013/079125
§ 371 (c)(1),
(2) Date: Apr. 26, 2016

(87) PCT Pub. No.: WO2015/063833
PCT Pub. Date: May 7, 2015

(65) Prior Publication Data

US 2016/0276119 A1 Sep. 22, 2016

(51) Int. Cl.
*H01H 37/54* (2006.01)
*H01H 11/00* (2006.01)
(Continued)

(52) U.S. Cl.
CPC .... *H01H 37/5427* (2013.01); *H01H 11/0056* (2013.01); *H01H 37/72* (2013.01);
(Continued)

(58) Field of Classification Search
CPC ..... H01H 37/5427; H01H 37/72; H01H 11/0056; H01H 2037/525; H01H 37/5418;
(Continued)

(56) References Cited

U.S. PATENT DOCUMENTS 3,171,925 A 3/1965 Malone et al.
3,562,690 A 2/1971 Vezza
(Continued)

FOREIGN PATENT DOCUMENTS

CN 1652276 A 8/2005
CN 101990694 A 3/2011
(Continued)

OTHER PUBLICATIONS

International Search Report dated Nov. 26, 2013, for International Patent Application No. PCT/JP2013/079125.
(Continued)

*Primary Examiner* — Anatoly Vortman
*Assistant Examiner* — Stephen S Sul
(74) *Attorney, Agent, or Firm* — Karceski IP Law, PLLC

(57) ABSTRACT

This invention is a thermally actuated switch in which a sealed vessel contains a fixed contact and a heat-sensitive-plate assembly that has a structure in which a movable contact is anchored to one lengthwise end of a heat-sensitive plate, one end of a metal support is anchored to the other end of said heat-sensitive plate, and the heat-sensitive plate is then drawn. The heat-sensitive-plate assembly has a dish-shaped drawn section near the middle of the heat-sensitive plate and has folded sections between the area where the movable contact is anchored and the widthwise edges of the heat-sensitive plate and also between the area where the metal support is anchored and the widthwise edges of the heat-sensitive plate.

15 Claims, 10 Drawing Sheets

(51) Int. Cl.
*H01H 37/72* (2006.01)
*H01H 37/52* (2006.01)

(52) U.S. Cl.
CPC ... *H01H 37/5418* (2013.01); *H01H 2037/525* (2013.01); *H01H 2037/528* (2013.01); *H01H 2037/5463* (2013.01)

(58) Field of Classification Search
CPC ..... H01H 2037/5463; H01H 2037/528; B21D 37/10
USPC ..... 337/333, 360, 362, 365, 380; 72/380
See application file for complete search history.

(56) References Cited

U.S. PATENT DOCUMENTS

| | | | | |
|---|---|---|---|---|
| 6,144,541 | A * | 11/2000 | Kato | H01H 73/303 337/333 |
| 7,075,403 | B2 * | 7/2006 | Unno | F04C 23/008 337/343 |
| 2003/0058079 | A1 * | 3/2003 | Sullivan | H01H 37/5418 337/365 |
| 2003/0074974 | A1 * | 4/2003 | Davis | G01L 5/0057 73/766 |
| 2010/0315193 | A1 * | 12/2010 | Hori | H01H 1/02376 337/326 |

FOREIGN PATENT DOCUMENTS

| | | | |
|---|---|---|---|
| GB | 794827 | | 5/1958 |
| JP | S428032 | Y1 | 4/1967 |
| JP | H10144189 | A | 5/1998 |
| JP | 2006100117 | A | 4/2006 |
| JP | 2006331693 | A | 12/2006 |
| KR | 900002618 | B1 | 4/1990 |
| KR | 20100114526 | A | 10/2010 |
| WO | WO 2009098735 | A1 | 8/2009 |

OTHER PUBLICATIONS

Extended European Search Report dated May 8, 2017, for European Patent Application No. 13896596.7.
Korean Invitation to Submit Arguments dated Feb. 20, 2017, for Korean Patent Application No. 10-2016-7009875.
Chinese Office Action dated Mar. 1, 2017, for Chinese Patent Application No. 201380080584.1
Chinese Office Action dated Nov. 3, 2017, for Chinese Patent Application No. 201380080584.1.
Chinese Office Action dated Apr. 23, 2018, for Chinese Patent Application No. 201380080584.1.
Indian Office Action dated Feb. 22, 2019, for Indian Patent Application No. 20167017592.

* cited by examiner

THERMALLY ACTUATED SWITCH AND FORMING DIES

CROSS-REFERENCE TO RELATED APPLICATION(S)

This is a National Stage Entry into the United States Patent and Trademark Office from International PCT Patent Application No. PCT/JP2013/079125, having an international filing date of Oct. 28, 2013, the entire contents of which is incorporated herein by reference.

FIELD OF THE INVENTION

The present invention relates to a thermally actuated switch having a contact open/close mechanism using a thermally actuated plate in a sealed container and dies for forming the thermally actuated plate.

DESCRIPTION OF RELATED ART

A thermally actuated switch of this type is disclosed in Japanese Patent Laid-Open No. 10-144189. The thermally actuated switch includes a thermally actuated plate assembly and a fixed contact in a sealed container made of a metal. The thermally actuated plate assembly has a configuration in which a movable contact is welded to one end of a thermally actuated plate formed, for example, of a bimetal and one end of a metal support is welded to the other end of the thermally actuated plate. The other end of the metal support is fixed to the inner surface of the sealed container. The movable contact and the fixed contact form an open/close contact.

The thermally actuated switch is disposed, for example, in a sealed housing of a sealed-type motorized compressor, such as a refrigerator and an air conditioner and used as a thermal protector that shuts off AC current flowing through a motor for the compressor. The thermally actuated plate is formed in a dish-like shape in a drawing process, and the curving direction of the thermally actuated plate reverses at a predetermined temperature. When the surroundings of the thermally actuated switch is heated to an abnormally high temperature, or when excessive current, such as locked rotor current, flows through the motor, the curving direction of the thermally actuated plate abruptly reverses so that the two contacts separate from each other. When the compressor stops operating so that the temperature decreases to a value smaller than or equal to the predetermined value, the curving direction of the thermally actuated plate abruptly reverses (abruptly return to original direction) so that the two contacts come into contact with each other again.

SUMMARY OF THE INVENTION

The thermally actuated plate is required to be durable enough to repeat the abrupt reverse action until a refrigerator, an air conditioner, or any other product reaches its lifetime. For example, when the welded portions of the thermally actuated plate or portions around the welded portions have insufficient strength, the repeated action is likely to cause fracture in the thermally actuated plate.

When the characteristics of the material of the thermally actuated plate vary, the reverse action temperature also varies. To address the problem, in the thermally actuated switch described above, strong force is externally applied to the sealed container in a predetermined position so as to deform the sealed container so that the contact pressure acting on the movable contact and the fixed contact of the thermally actuated plate is adjusted to calibrate the reverse action temperature. To widen the range over which the reverse action temperature can be calibrated, it is necessary to increase the upper limit of the contact pressure described above. When the contact pressure is increased, however, permanent bend, fracture, or any other defect tends to occur.

An object of the present invention is to provide a thermally actuated switch that is highly durable and has a wide range over which the reverse action temperature can be calibrated and dies for forming a thermally actuated plate.

A thermally actuated switch according to the present invention is a thermally actuated switch in which a thermally actuated plate assembly and a fixed contact are accommodated in a sealed container made of a metal, the thermally actuated plate assembly has a configuration in which a movable contact is anchored to one lengthwise end of a rectangular thermally actuated plate, one end of a metal support is anchored to another end of the thermally actuated plate, and the thermally actuated plate to which the movable contact and the metal support have been anchored is drawn into a dish-like shape, the movable contact and the fixed contact form an open/close contact, and another end of the metal support is fixed to an inner surface of the sealed container such that the thermally actuated plate assembly is supported so as to form a cantilever, wherein the thermally actuated plate assembly has a dish-shaped drawn section in a vicinity of a central portion of the thermally actuated plate and further has respective folded sections between a portion where the movable contact is anchored to the thermally actuated plate and widthwise opposite ends of the thermally actuated plate and between a portion where the metal support is anchored to the thermally actuated plate and the widthwise opposite ends of the thermally actuated plate.

Forming dies according to the present invention are forming dies that draw a thermally actuated plate assembly in which a movable contact is anchored to one longitudinal end of a rectangular thermally actuated plate and one end of a metal support is anchored to another end of the thermally actuated plate in such a way that a dish-shaped concave die surface and a dish-shaped convex die surface sandwich and pressurize the thermally actuated plate, wherein each of the die surfaces is a circular dish-shaped surface having a diameter greater than a widthwise width of the thermally actuated plate but smaller than a distance between farthest points of overlapping portions where the movable contact and the metal support overlap with the thermally actuated plate, and cutouts each of which is formed an arc are formed in portions of each of the die surfaces that correspond to the overlapping portion where the movable contact overlaps with the thermally actuated plate and the overlapping portion where the metal support overlaps with the thermally actuated plate, with the cutouts surrounding the portions corresponding to the overlapping portions.

When the thermally actuated plate to which the movable contact and the metal support have been anchored is drawn into a dish-like shape, the folded sections can be formed in the thermally actuated plate. When the forming dies according to the present invention are used to perform the drawing, the thermally actuated plate can be drawn into a dish-like shape and the folded sections can be formed in the thermally actuated plate while clearances for avoiding contact with the portion where the movable contact overlaps with the thermally actuated plate and the portion where the metal support overlaps with the thermally actuated plate are provided.

When the folded sections are formed in the thermally actuated plate, the durability of the thermally actuated plate that undergoes repeated reverse action is improved. Further, since the strength of the thermally actuated plate increases and permanent bend, fracture, or any other defect is therefore unlikely to occur, the contact pressure acting on the contacts can be increased in the calibration of the reverse action temperature performed by the deformation produced by strong force application. The range over which the reverse action temperature can be calibrated can therefore be widened.

BRIEF DESCRIPTION OF THE DRAWINGS

FIG. 73 is a transverse cross-sectional view taken along the line VIIB-VIIB in FIG. 7A.

DESCRIPTION OF EMBODIMENTS OF THE INVENTION

An example in which a thermally actuated switch according to the present invention is used as a thermal protector that shuts off AC current flowing through a motor for a compressor will be described below with reference to the drawings.

Figure 1:
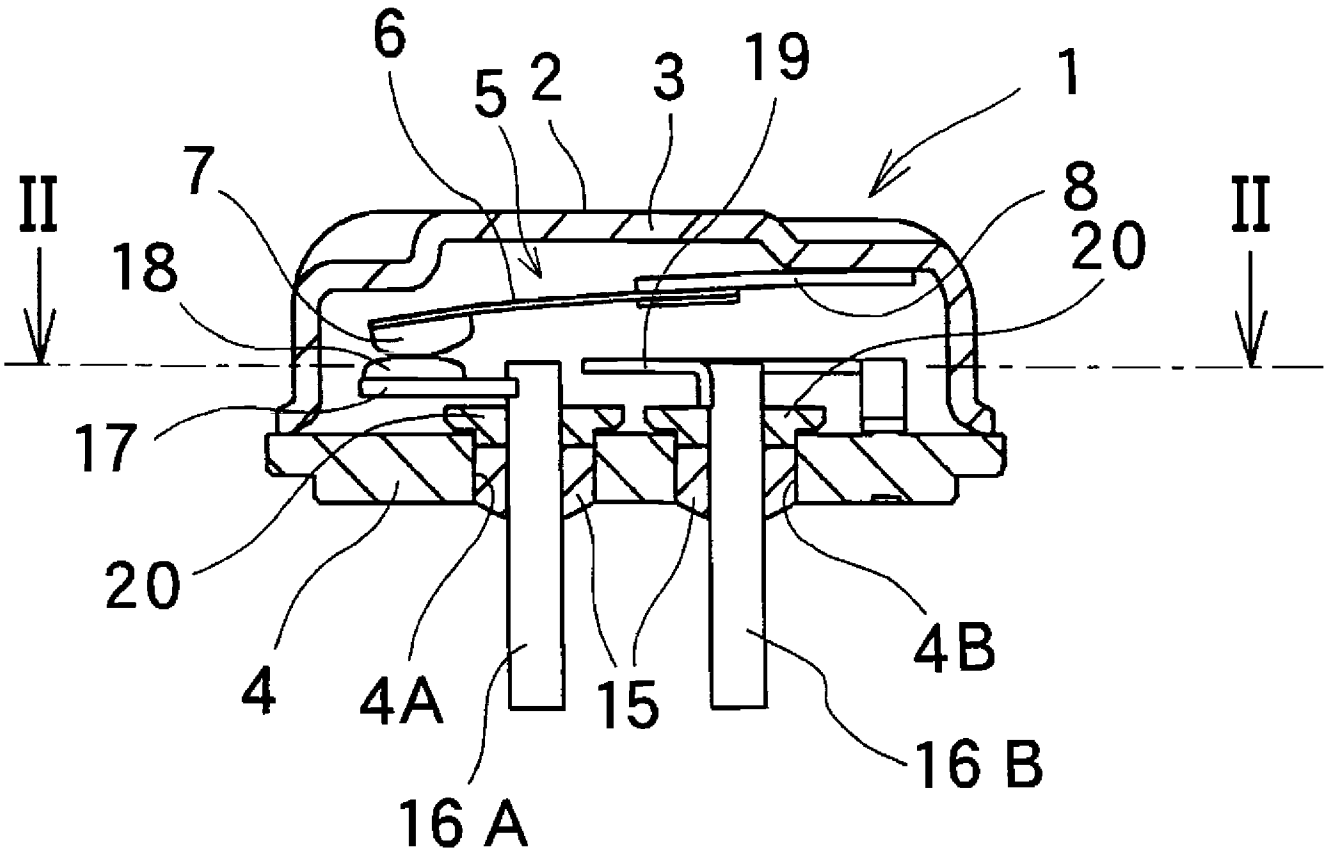
FIG. 1 is a longitudinal cross-sectional view of a thermally actuated switch showing in an example of the present invention.

A sealed container 2 of a thermally actuated switch 1 is formed of a housing 3 made of a metal and a lid 4, as shown in FIG. 1. The housing 3 is formed of an iron plate or any other plate drawn in press working into an elongated dome-like shape. Lengthwise opposite end portions of the housing 3 are formed so as to be roughly spherical, and a central portion of the housing 3 that connects the opposite end portions has a semicircular cross-sectional shape. The lid 4 is formed of an iron plate thicker than the housing 3 and formed in an elliptical shape, and the lid 4 is hermetically attached to an open end of the housing 3, for example, in ring projection welding.

Figure 5:
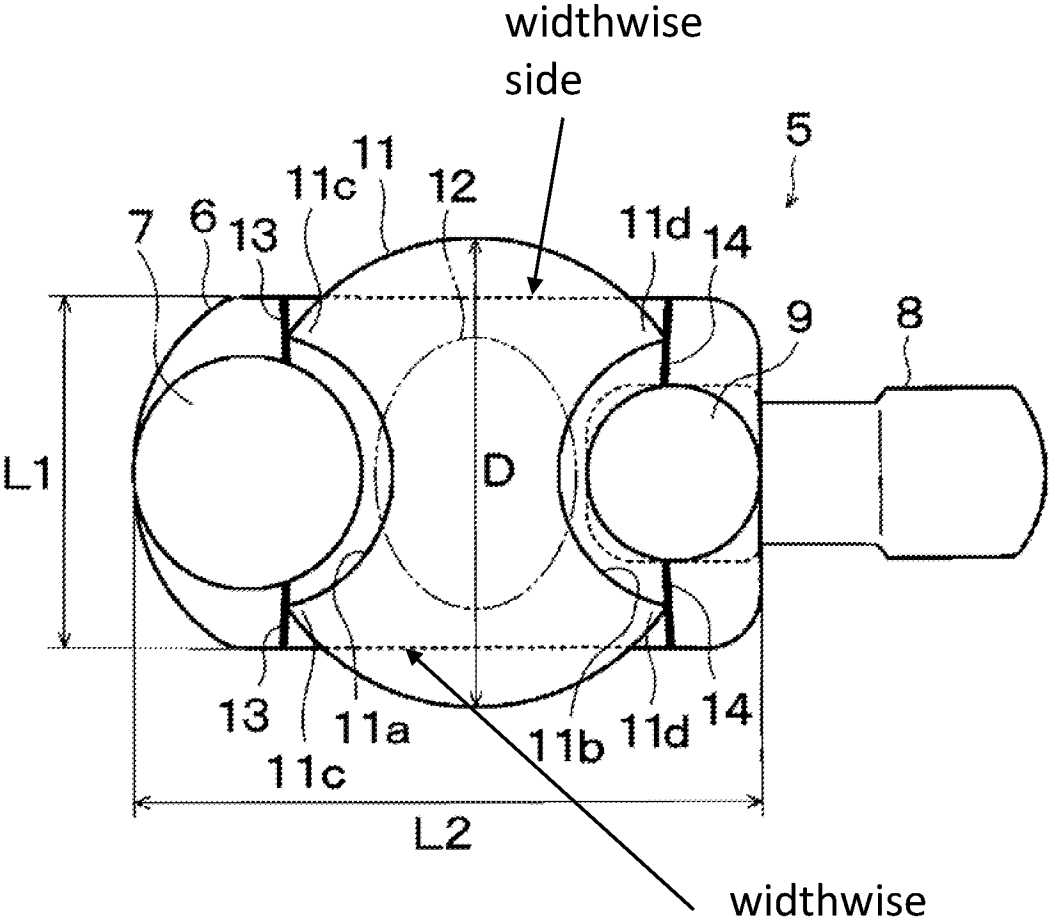
FIG. 5 shows the relationship between a thermally actuated plate assembly and a forming die.

The sealed container 2 accommodates a thermally actuated plate assembly 5. In the thermally actuated plate assembly 5, a movable contact 7 is anchored to one lengthwise end of a thermally actuated plate 6, which has a rectangular shape, and one end of a support 8 made of a metal is anchored to the other end of the thermally actuated plate 6, as shown in FIGS. 1 and 5. The thermally actuated plate 6 to which the movable contact 7 and the support 8 have been anchored is drawn into a shallow dish-like shape. After the drawing, the surface of the thermally actuated plate 6 on the side to which the movable contact 7 is anchored forms a concave dish-shaped surface, and the surface of the thermally actuated plate 6 on the side to which the support 8 is anchored forms a convex dish-shaped surface. The other end of the support 8 is fixed to the inner surface of the sealed container 2, and the thermally actuated plate assembly 5 is supported by the support 8 so as to form a cantilever. The thermally actuated plate 6 is formed of a member that deforms when heated, such as a bimetal and a tri-metal, and the curving direction of the thermally actuated plate 6 abruptly reverses when the temperature rises and reaches a predetermined value and further abruptly reverses (abruptly returns to original direction) when the temperature lowers and reaches the predetermined value.

Figure 6A:
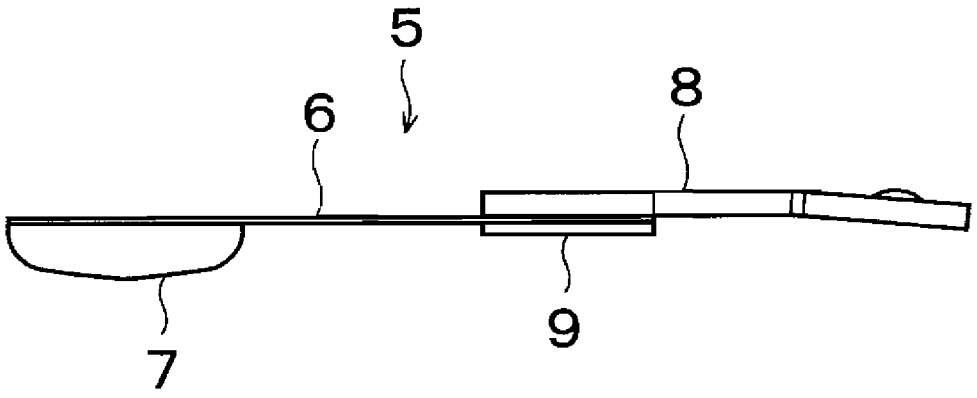
FIG. 6A is a side view of the thermally actuated plate assembly before drawing.

The anchoring of the movable contact 7 and the support 8 to the thermally actuated plate 6 is achieved, for example, by projection welding. To increase the welding strength, the welding of the support 8 to the thermally actuated plate 6 is performed with an adjoining plate 9, which is a welding piece made of a metal, adjoined to the thermally actuated plate 6. Each of the movable contact 7, the support 8, and the adjoining plate 9 has a projection for welding formed thereon in advance. FIG. 6A shows the shape of the thermally actuated plate assembly 5 after the welding but before the drawing.

Figure 6B:
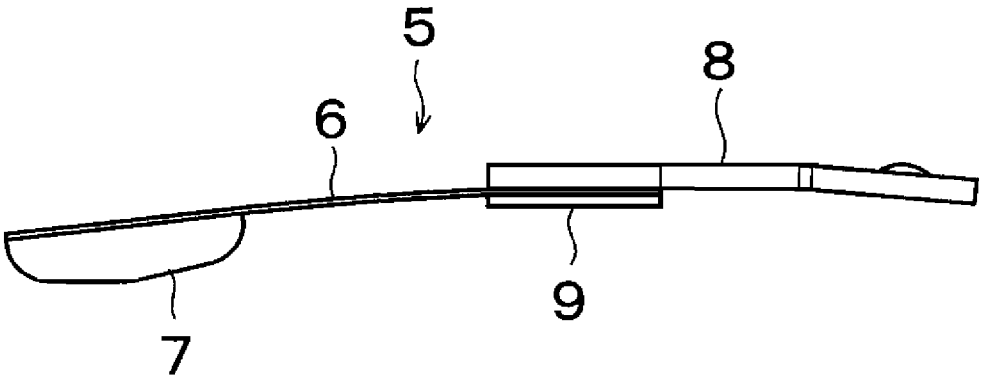
FIG. 6B is a side view of the thermally actuated plate assembly after drawing.
Figure 7A:
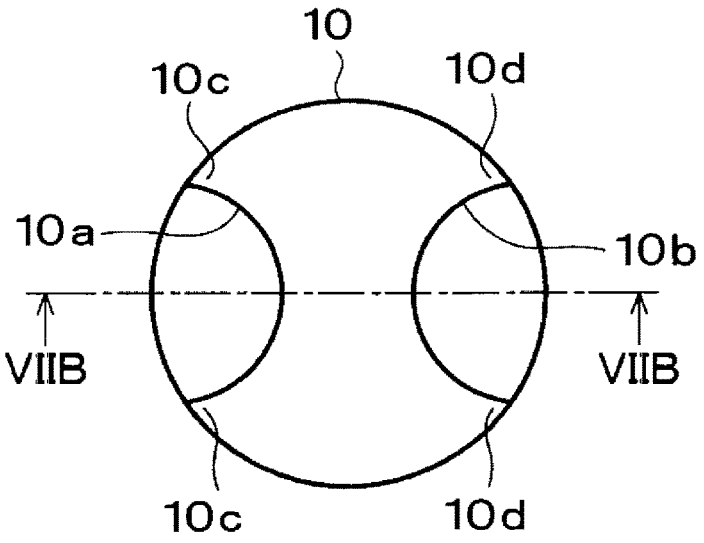
FIG. 7A is a plan view of an upper forming die.
Figure 7B:
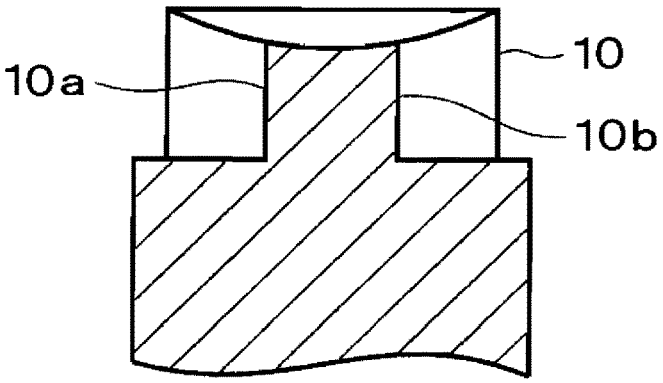
Figure 8A:
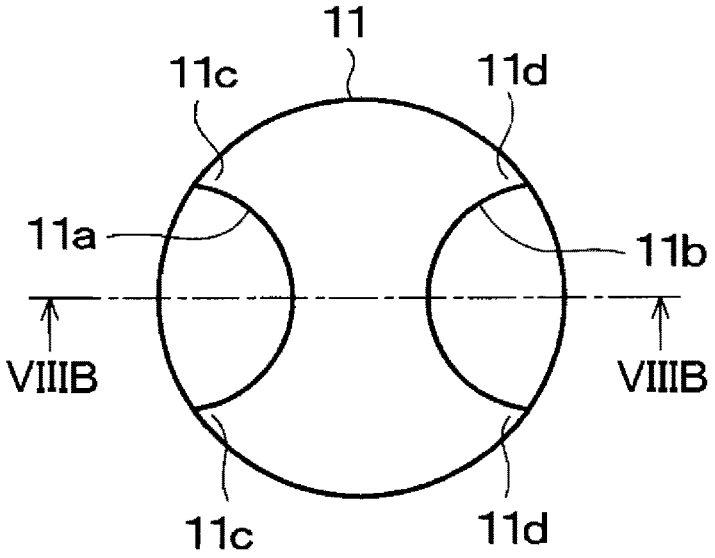
FIG. 8A is a plan view of a lower forming die.
Figure 8B:
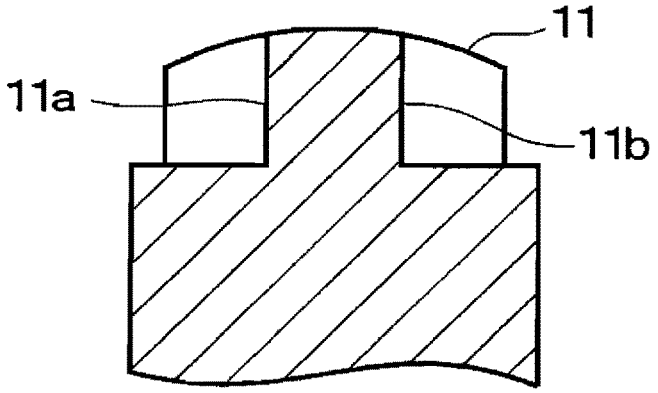
FIG. 8B is a transverse cross-sectional view taken along the line VIIIB-VIIIB in FIG. 8A.

After the welding, the thermally actuated plate 6 of the thermally actuated plate assembly 5 is drawn by using a press work apparatus. FIG. 6B shows the shape of the thermally actuated plate assembly 5 after the drawing. FIGS. 7A and 7B and FIGS. 8A and 8B show the shapes of an upper forming die 10 and a lower forming die 11, which are installed in the press work apparatus. The die surface of the lower forming die 11 is a circular dish-shaped convex surface that is longer than the widthwise width L1 of the thermally actuated plate 6 and has a diameter D smaller than a distance L2 between the farthest points of the overlapping portions where the movable contact 7 and the support 8 overlap with the thermally actuated plate 6. The die surface of the upper forming die 10 is also a circular dish-shaped concave surface having the same diameter D.

Cutouts 10*a* and 11*a*, each of which is formed of an arc, are formed in portions of the die surfaces of the forming dies 10 and 11 that correspond to the overlapping portion where the movable contact 7 overlaps with the thermally actuated plate 6, and the arcuate cutouts 10*a* and 11*a* surround the portions corresponding to the overlapping portion. Similarly, cutouts 10*b* and 11*b*, each of which is formed of an arc, are formed in portions of the die surfaces of the forming dies 10 and 11 that correspond to the overlapping portion where the support 8 (adjoining plate 9) overlaps with the thermally actuated plate 6, and the arcuate cutouts 10*b* and 11*b* surround the portions corresponding to the overlapping portion.

When the die surfaces of the forming dies 10 and 11 are used to press (sandwich and pressurize) the thermally actuated plate 6, corner portions 10*c* and 11*c*, which are sandwiched between the outer circumferences of the circular dish-shaped surfaces and the arcs of the cutouts 10*a*, 11*a*, are located between the overlapping portion where the movable contact 7 overlaps with the thermally actuated plate 6 and the widthwise opposite ends of the thermally actuated plate 6. The front ends of the corner portions 10*c* and 11*c* are shifted toward the overlapping portion described above and reach a position corresponding to half of the diameter of the overlapping portion. Similarly, corner portions 10*d* and 11*d*, which are sandwiched between the outer circumferences of the circular dish-shaped surfaces and the arcs of the cutouts 10*b*, 11*b*, are located between the overlapping portion where the support 8 overlaps with the thermally actuated plate 6 and the widthwise opposite ends of the thermally actuated plate 6. The front ends of the corner portions 10*d* and 11*d* are shifted toward the overlapping portion described above and reach a position corresponding to half of the diameter of the overlapping portion.

When the thermally actuated plate 6 is pressed between the die surfaces of the thus configured forming dies 10 and 11, a dish-shaped drawn section 12 is formed in a portion in the vicinity of a central portion of the thermally actuated plate 6, as shown in FIG. 5. At the same time, a folded section 13 is formed between the portion where the movable contact 7 is anchored and the widthwise opposite ends of the thermally actuated plate 6, and a folded section 14 is formed between the portion where the support 8 is anchored and the widthwise opposite ends of the thermally actuated plate 6. Each of the folded section 13 and 14 has a fold extending roughly in the widthwise direction of the thermally actuated plate 6. The fold is a valley fold when viewed from the side where the movable contact 7 is anchored.

The lid 4 is provided with through holes 4A and 48. Conductive terminal pins 16A and 16B are inserted into the through holes 4A and 48, respectively, and hermetically and insulatively fixed therein with a compression-type hermetic seal formed of an electrically insulating filler 15, such as glass made in consideration of the thermal expansion coefficient. A contact support 17 made of a metal is anchored to the conductive terminal pin 16A, specifically, a portion in the vicinity of the front end thereof in the sealed container. A fixed contact 18 is anchored to the contact support 17 and in the position facing the movable contact 7. The movable contact 7 and the fixed contact 18 form an open/close contact.

One end of a heater 19 is fixed to the conductive terminal 168, specifically, a portion in the vicinity of the front end thereof in the sealed container. The other end of the heater 19 is fixed onto the lid 4. The heater 19 is disposed roughly in parallel to the thermally actuated plate 6 along the circumference of the conductive terminal 168, so that heat generated by the heater 19 is efficiently transferred to the thermally actuated plate 6.

Figure 2:
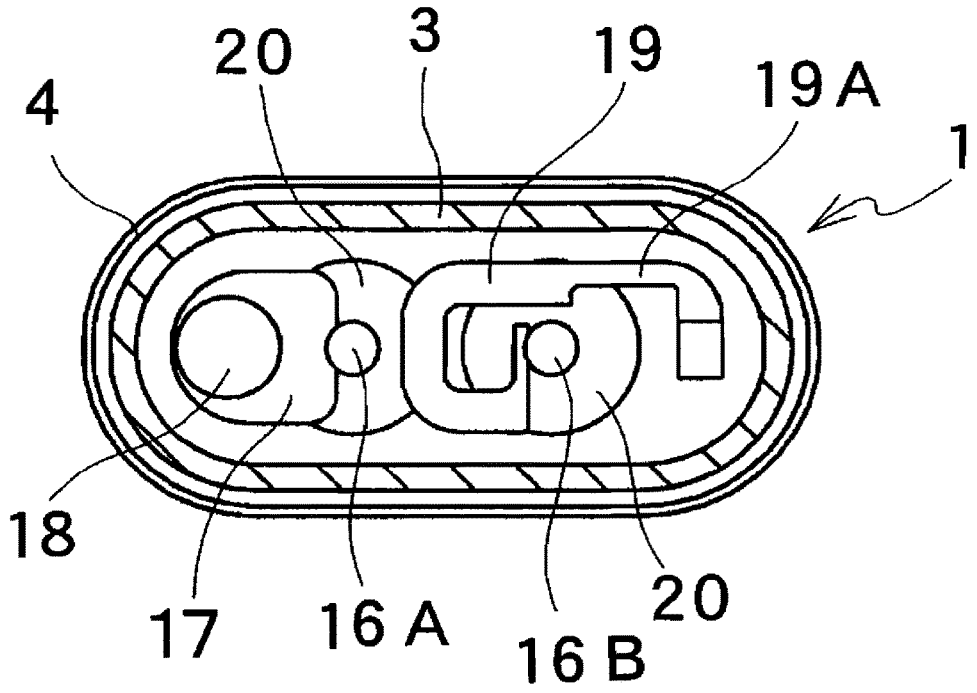
FIG. 2 is a transverse cross-sectional view taken along the line II-II in FIG. 1.
Figure 3:
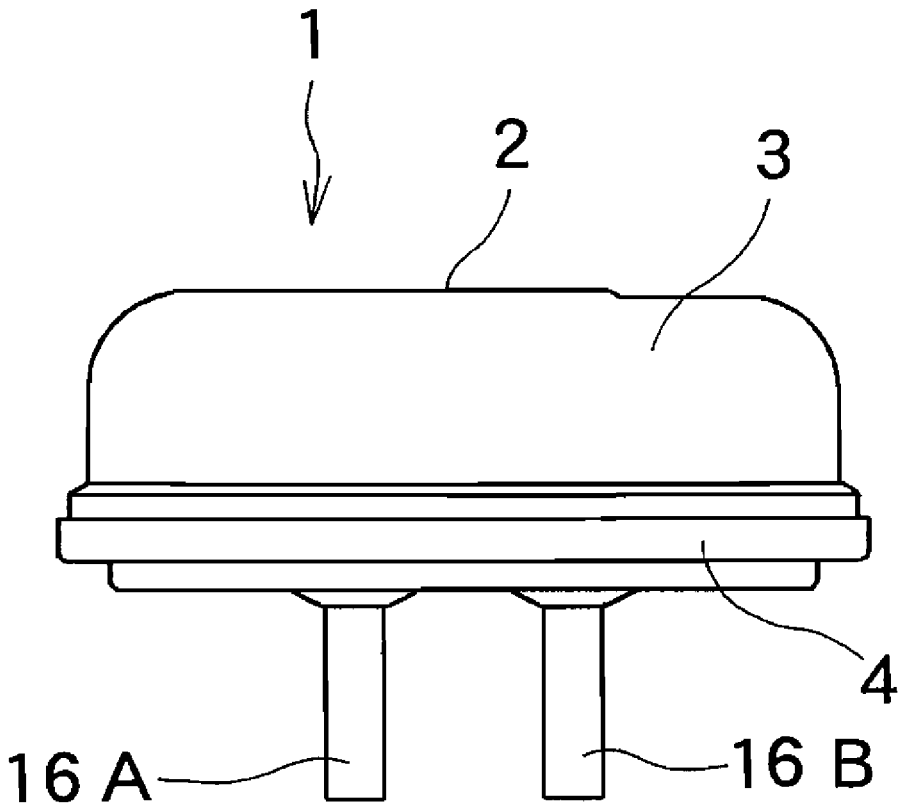
FIG. 3 is a side view of the thermally actuated switch.
Figure 4:
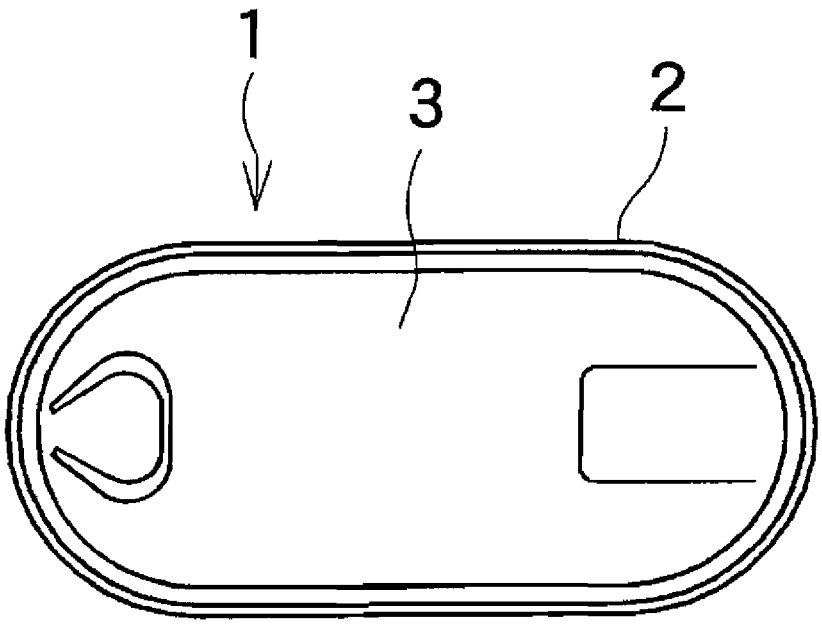
FIG. 4 is a plan view of the thermally actuated switch.

The heater 19 is provided with a melting section 19A, which has a cross-sectional area smaller than those of the other portions of the heater 19, as shown in FIG. 2. When the compressor operates normally, operation current in the motor does not melt the melting section 19A. When the motor enters a locked rotor state, the curving direction of the thermally actuated plate 6 quickly reverses to separate the contacts 7 and 18 from each other, and the melting section 19A does not melt. However, when the thermally actuated switch 1 is repeatedly opened and closed for a long period and the number of open/close operations exceeds a guaranteed operation frequency, the movable contact 7 and the fixed contact 18 are unintentionally welded to each other and cannot be separate from each other in some cases. In this state, when the rotor of the motor is locked, excessive current raises the temperature of the melting section 19A, which eventually melts, whereby electricity conducted to the motor can be reliably shut off.

Helium is sealed in the sealed container 2, and the proportion of the helium is greater than or equal to 50% but smaller than or equal to 95%. The remaining gas sealed in the sealed container 2 is nitrogen, dry air, and other gases. When excessive current flows through the motor, for example, in the case where the rotor of the motor is locked, the sealed helium, which has high heat conductivity, allows the heat generated by the heater 19 to be quickly transferred to the thermally actuated plate 6, whereby the period spent until the contacts 7 and 18 are separate from each other (short time trip: S/T) can be shortened.

In view of the fact that increasing the proportion of the sealed helium tends to lower the withstand voltage, the proportion of the sealed helium is preferably set to be greater than or equal to 30% but smaller than or equal to 95%, particularly preferably greater than or equal to 50% but smaller than or equal to 95% in the case of a typical commercial power supply that provides AC voltage from about 100 to 260 V.

Heat-resistant inorganic insulating members 20, which are made, for example, of a ceramic material or zirconia (zirconium oxide), are intimately (with no gap) in contact with and fixed onto the fillers 15, which fix the conductive terminal pins 16A and 16B. Sufficient insulation can therefore be maintained even if a sputtered material produced when the heater 19 melts the melting section 19A adheres to the surface of the heat-resistant inorganic insulating members 20.

When the current flowing through the motor is normal operation current including short-period starting current, the contacts 7 and 18 of the thermally actuated switch 1 remain in contact with each other, and the motor keeps operating. On the other hand, when current larger than in normal operation keeps flowing through the motor because the load on the motor increases, when the motor is locked and extremely large locked rotor current keeps flowing for at least several seconds, when the refrigerant in a sealed housing of the compressor is heated to an abnormally high temperature, or in other occasions, the curving direction of the thermally actuated plate 6 reverses and the contacts 7 and 18 are separate from each other to shut off the current in the motor. Thereafter, when the internal temperature of the thermally actuated switch 1 lowers, the curving direction of the thermally actuated plate 6 reverses again and returns to its original direction, and conduction of electricity to the motor resumes.

A description will next be made of the drawing of the thermally actuated plate 6 and the folded sections 13 and 14 formed by the drawing. When the thermally actuated plate 6 to which the movable contact 7 and the support 8 are welded is drawn in press working, the die surfaces of the forming dies 10 and 11 need clearances for avoiding contact with the portion where the movable contact 7 overlaps with the thermally actuated plate 6 and the portion where the support 8 overlaps with the thermally actuated plate 6. The cutouts 10*a* and 11*a* and the cutouts 10*b* and 11*b* correspond to the clearances.

Let L1 be the widthwise width of the thermally actuated plate 6, L2 be the distance between the farthest points of the overlapping portion where the movable contact 7 and the support 8 overlap with the thermally actuated plate 6, and D be the diameter of the die surfaces. The folded sections 13 and 14, along with the drawn section 12, are formed in the thermally actuated plate 6 when the die surfaces satisfy conditions (1) and (2) shown below. Further, an additional condition (3) is satisfied, the folded sections 13 and 14 are more reliably formed.

(1) L2>D>L1

(2) In the portions of the forming dies that correspond to the overlapping portions described above, the cutouts 10*a*,

11*a*, 10*b*, and 11*b*, each of which is formed of an arc and which surround the portions corresponding to the overlapping portions, are formed.

(3) In the press working, the corner portions 10*c*, 11*c*, 10*d*, and 11*d* are located between the overlapping portions of the thermally actuated plate 6 and the widthwise opposite ends of the thermally actuated plate 6. In this case, the front ends of the corner portions 10*c*, 11*c*, 10*d*, and 11*d* are shifted toward the overlapping portions described above and reach positions corresponding to roughly half of the diameters of overlapping portions (front ends shown in FIG. 5).

FIG. 5 shows a preferable relationship between the thermally actuated plate assembly 5 and the lower forming die 11 from a viewpoint of formation of the folded sections 13 and 14. The folded sections 13 and 14 are folds formed between the portions where the movable contact 7 and the support 8 are anchored to the thermally actuated plate 6 and the widthwise opposite ends of the thermally actuated plate 6 because the welded movable contact 7 and support 8 prevents the thermally actuated plate 6 from being completely deformed. The folds in the present example linearly extend but are slightly inclined to the widthwise direction of the thermally actuated plate. However, depending on the shape of the thermally actuated plate 6, the relative size of the die surfaces, the relative size of the overlapping portions, and other factors, the folds may extend exactly along the widthwise direction, may extend at an inclination of a certain angle (30 degrees or smaller, for example) with respect to the widthwise direction, or may extend in the form of a curved line instead of a straight line. Any of the folds extending in the directions described above does not prevent the reverse action of the thermally actuated plate 6.

The folded sections 13 and 14, even when the degree of folding is small, have a function of enhancing the strength (viscous strength) of the thermally actuated plate 6. According to the enhancement, the portions that are located around the overlapping portions described above and do not have the dish-like shape are unlikely to be deformed or experience fatigue breakage (fracture) due to the repeated reverse action, whereby the durability of the thermally actuated switch 1 is improved. Further, the calibration of the reverse action temperature of the thermally actuated switch 1 is performed by externally applying strong force to the sealed container 2 in a predetermined position to deform the sealed container 2 so that the contact pressure acting on the contacts is adjusted. Since the thermally actuated plate 6 has high strength, the upper limit of the contact pressure in the calibration can be increased, whereby the calibratable range (adjustment margin) can be widened, for example, by 5° C.

Figure 9:
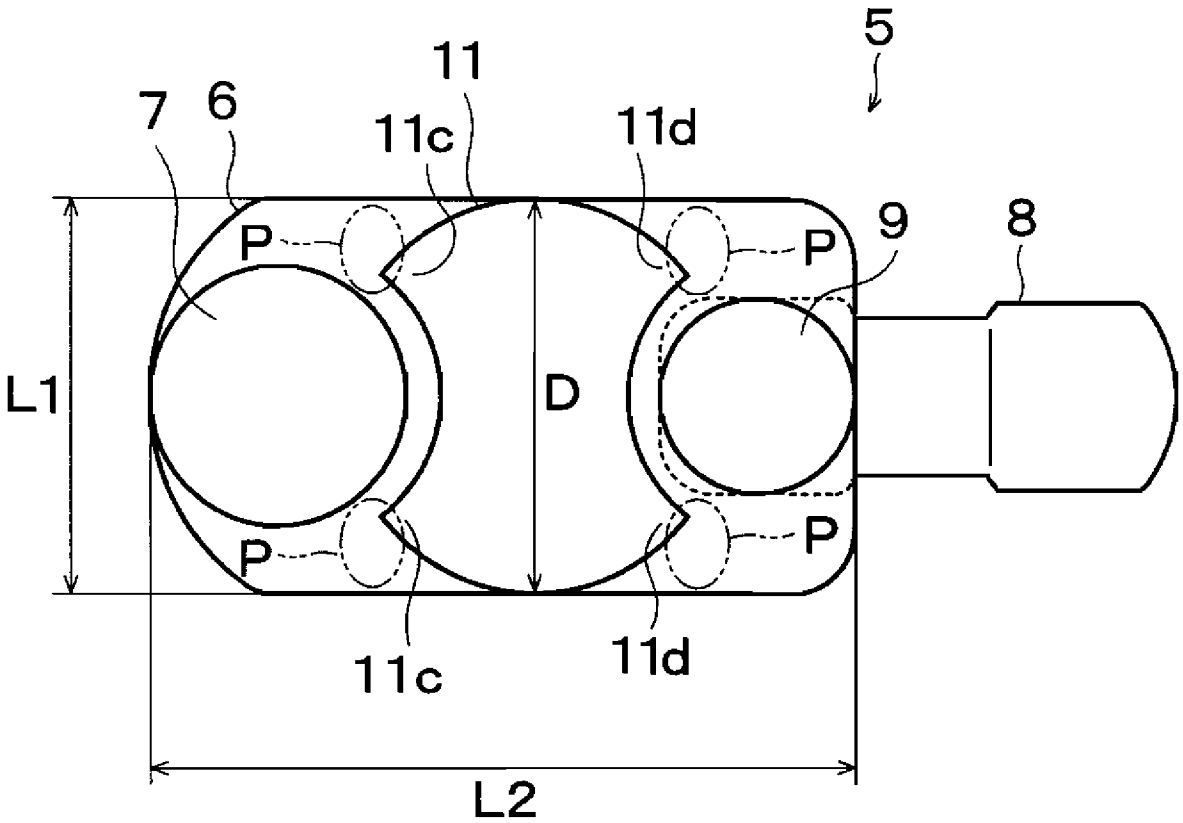
FIG. 9 is equivalent to FIG. 5 and shows a case where the diameter D of a die surface is equal to the widthwise width L1 of a thermally actuated plate.
Figure 10:
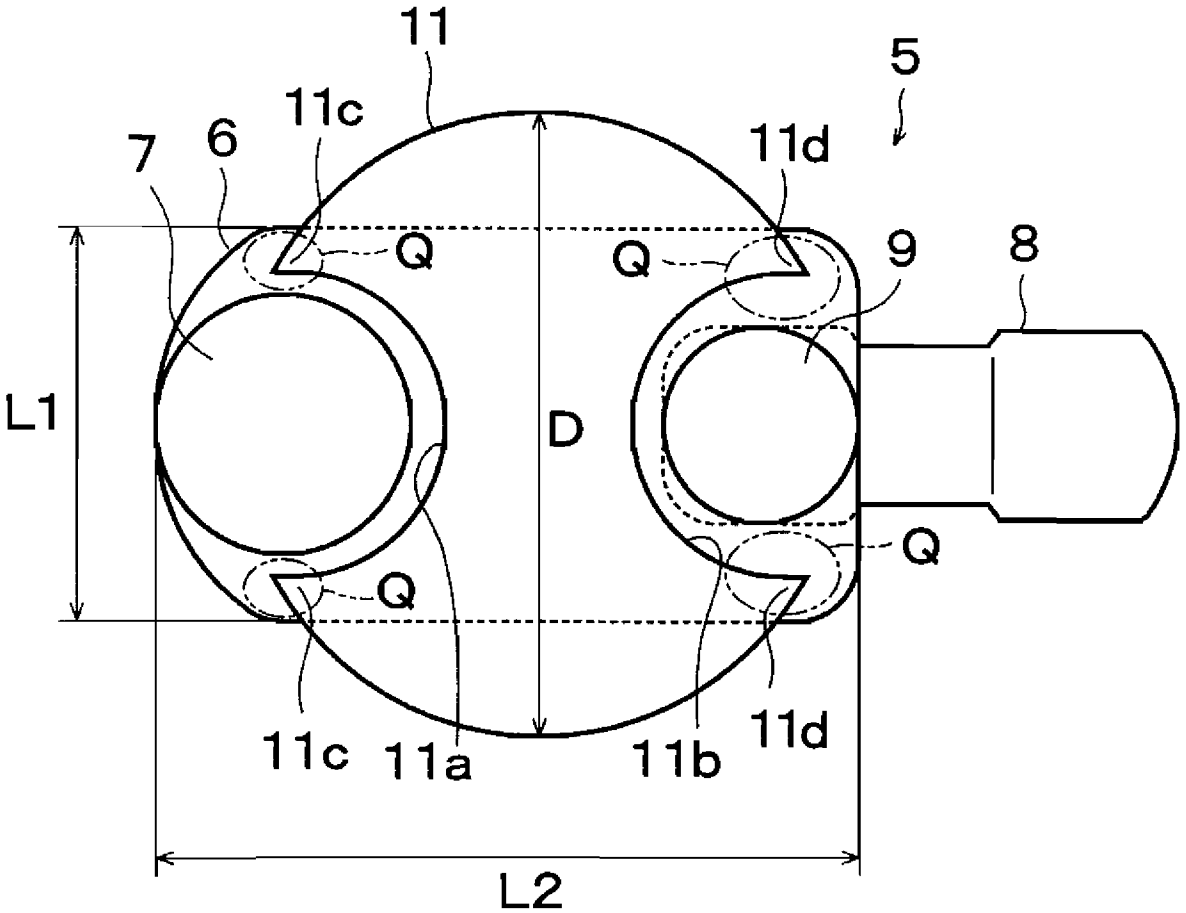
FIG. 10 is equivalent to FIG. 5 and shows a case where the diameter D of the die surface is close to the distance L2 between the farthest points of portions where a movable contact and a support overlap with the thermally actuated plate.

FIG. 9 shows a case where the diameter D is equal to L1. Since the portion that undergoes the press working has a small area, no folded section 13 or 14 is formed. As a result, the stability of the thermally actuated plate 6 is low, and repeated reverse action tends to produce permanent bend in the vicinity of positions P, resulting in a decrease in the durability as compared with the durability in the configuration shown in FIG. 5. FIG. 10 shows a case where the diameter D is close to L2. Since the portion that undergoes the press working has a large area, the folded sections 13 and 14 are unlikely to be formed. Further, since the cutouts 11*a* and 11*b* surround a larger area of the above-mentioned overlapping portions of the thermally actuated plate 6, strain tends to be left in the welded portions in the press working. As a result, fatigue breakage (rupture) tends to occur in the vicinity of positions Q, and the durability slightly decreases as compared with the durability in the configuration shown in FIG. 5.

As described above, the thermally actuated plate 6 according to the present example includes a dish-shaped drawn section 12 in the vicinity of a central portion of the thermally actuated plate 6 as well as the folded sections 13 and 14 between the welded portions where the movable contact 7 and the support 8 are welded to the thermally actuated plate 6 and the widthwise opposite ends of the thermally actuated plate 6. The presence of the folded sections 13 and 14 enhances the strength of the thermally actuated plate 6, whereby the durability of the thermally actuated switch 1 is improved. The folded sections 13 and 14 help improve the durability even when the folds are shallow. Further, since the range over which the reverse action temperature can be calibrated by the deformation produced by strong force application widens, the acceptance rate of the thermally actuated switch 1 in terms of operation temperature is improved, whereby the productivity of the thermally actuated switch 1 can be increased.

Since the die surfaces of the forming dies 10 and 11, which press the thermally actuated plate 6, have at least the configurations (1) and (2) described above, appropriate folded sections 13 and 14 are formed in the thermally actuated plate 6. Further, the amount of strain induced in the pressed boundary portion of the thermally actuated plate 6 in the press working and the amount of residual strain in the welded portions decrease. As a result, the durability of the thermally actuated plate 6 is increased, and the thermally actuated switch 1 can reliably operate as a thermal protector until a refrigerator, an air conditioner, or any other product reaches its lifetime.

The folded sections 13 and 14 are produced by welding the movable contact 7 and the support 8 to the thermally actuated plate 6 and then causing the thermally actuated plate 6 to undergo press working. The manufacturing method reduces variation in the reverse action temperature of the thermally actuated plate 6 due to the welding strain as compared with a manufacturing method in which the welding is performed after the press working, whereby the quality of the thermally actuated switch 1 can be stabilized.

The preferably example of the present invention has been described, but the present invention is not limited to the example described above, and a variety of changes and extensions can be made thereto to the extent that they do not depart from the substance of the present invention.

Each of the cutouts formed of an arc in the present invention is not intended to refer only to a cutout formed only of an arc having single curvature in an exact sense. Each of the cutouts in the present invention also includes a cutout formed of an elliptical arc, a combination of a plurality of arcs having different values of curvature, an arc having continuously changing curvature, an arc partially formed of a straight line, and other arcs. Use of a die surface having a cutout formed of any of the variety of arcs described above still allows formation of the folded sections 13 and 14 in the same manner described above, and the strength of the thermally actuated plate 6 and the durability of the thermally actuated switch 1 are improved.

Two or more pairs of thermally actuated plate assemblies 5 may be accommodated in the sealed container 2. That is, two or more pairs of open/close contacts each formed of the movable contact 7 and the fixed contact 18 may be provided.

When the support 8 is welded to each of the thermally actuated plates 6, the adjoining plate 9 may be used as required.

The other end of the support 8 is fixed to the sealed container 2, specifically, a portion thereof in the vicinity of one end thereof but may instead be fixed to another portion of the sealed container 2, for example, a portion thereof in the vicinity of a central portion thereof.

The heater 19 and the heat-resistant inorganic insulating members 20 may be provided as required.

The two conductive terminal pins 16A and 16B are provided through the lid 4. Instead, only one conductive terminal pin may be provided, and the lid 4 made of a metal may be used as the other terminal.

The shape of the thermally actuated plate 6 may be a roughly rectangular shape (strip-like shape).

The shape of the sealed container 2 is not limited to the elongated dome-like shape. The elongated dome-like shape is not necessarily employed, and ribs may, for example, be provided along the longitudinal direction of the container as long as the ribs provide sufficient strength.

The thermally actuated switch 1 used as a thermal protector can be used in an induction motor, a synchronous motor, and a variety of other motors.

INDUSTRIAL APPLICABILITY

As described above, the thermally actuated switch and the forming dies according to the present invention are useful for a thermal protector of a motor for a compressor and for manufacturing of the thermal protector.

The invention claimed is:

1. A thermally actuated switch, comprising:

a sealed container made of metal;

a thermally actuated plate defining a longitudinal direction between a first position and a second position and a widthwise direction between widthwise sides;

a fixed contact accommodated in the sealed container;

a movable contact anchored to a first end of the thermally actuated plate at the first position; and a metal support anchored at a first end to a second end of the thermally actuated plate at the second position, wherein the thermally actuated plate is drawn into dish-shaped drawn section in a vicinity of a central portion, wherein the movable contact and the fixed contact form an open/close contact, wherein a second end of the metal support is fixed to an inner surface of the sealed container to form a cantilever, wherein the thermally actuated plate has a first folded section extending between the widthwise sides with the movable contact covering a portion of the first folded section, and wherein the thermally actuated plate has a second folded section extending between the widthwise sides with an adjoining plate covering a portion of the second folded section.

2. The thermally actuated switch according to claim 1, wherein each of the folded sections has a fold extending in the widthwise direction of the thermally actuated plate.

3. The thermally actuated switch according to claim 2, wherein the drawn section and the folded sections of the thermally actuated plate are formed by sandwiching and pressing the thermally actuated plate to which the movable contact and the first of the metal support have been anchored between a dish-shaped concave die surface and a dish-shaped convex die surface.

4. The thermally actuated switch according to claim 3, wherein each of the die surfaces is a circular dish-shaped surface having a diameter greater than a width of the thermally actuated plate but smaller than a distance between farthest points of overlapping portions where the movable contact and the metal support overlap with the thermally actuated plate, and cutouts, each of which is formed as an arc, are formed in portions of the die surface that correspond to the overlapping portion where the movable contact overlaps with the thermally actuated plate and the overlapping portion where the metal support overlaps with the thermally actuated plate, with the cutouts surrounding the portions corresponding to the overlapping portions.

5. The thermally actuated switch according to claim 4, wherein each of the die surfaces is formed such that, when the die surfaces sandwich and press the thermally actuated plate, corner portions sandwiched between outer circumferences of the circular dish-shaped surfaces and the arcs of the cutouts are located between the overlapping portions and the widthwise sides of the thermally actuated plate.

6. The thermally actuated switch according to claim 5, wherein, when the die surfaces sandwich and press the thermally actuated plate, front ends of the corner portions of the thermally actuated plate are shifted in the longitudinal direction thereof toward the overlapping portions and reach a position corresponding to half of a diameter of the overlapping portions.

7. The thermally actuated switch according to claim 1, wherein each of the folded sections has a fold inclined at an angle with respect to the widthwise direction of the thermally actuated plate.

8. The thermally actuated switch according to claim 7, wherein the drawn section and the folded sections of the thermally actuated plate are formed by sandwiching and pressing the thermally actuated plate to which the movable contact and the first of the metal support have been anchored between a dish-shaped concave die surface and a dish-shaped convex die surface.

9. The thermally actuated switch according to claim 8, wherein each of the die surfaces is a circular dish-shaped surface having a diameter greater than a width of the thermally actuated plate but smaller than a distance between farthest points of overlapping portions where the movable contact and the metal support overlap with the thermally actuated plate, and cutouts, each of which is formed as an arc, are formed in portions of the die surface that correspond to the overlapping portion where the movable contact overlaps with the thermally actuated plate and the overlapping portion where the metal support overlaps with the thermally actuated plate, with the cutouts surrounding the portions corresponding to the overlapping portions.

10. The thermally actuated switch according to claim 9, wherein each of the die surfaces is formed such that, when the die surfaces sandwich and press the thermally actuated plate, corner portions sandwiched between outer circumferences of the circular dish-shaped surfaces and the arcs of the cutouts are located between the overlapping portions and the widthwise sides of the thermally actuated plate.

11. The thermally actuated switch according to claim 10, wherein, when the die surfaces sandwich and press the thermally actuated plate, front ends of the corner portions of the thermally actuated plate are shifted in the longitudinal direction thereof toward the overlapping portions and reach a position corresponding to half of a diameter of the overlapping portions.

12. The thermally actuated switch according to claim 1, wherein the dish-shaped drawn section and the folded sections of the thermally actuated plate are formed by sandwiching and pressing the thermally actuated plate to which the movable contact and the first end of the metal support have been anchored between a dish-shaped concave die surface and a dish-shaped convex die surface.

13. The thermally actuated switch according to claim 12, wherein each of the die surfaces is a circular dish-shaped surface having a diameter greater than a width of the thermally actuated plate but smaller than a distance between farthest points of overlapping portions where the movable contact and the metal support overlap with the thermally actuated plate, and cutouts, each of which is formed as an arc, are formed in portions of the die surface that correspond to the overlapping portion where the movable contact overlaps with the thermally actuated plate and the overlapping portion where the metal support overlaps with the thermally actuated plate, with the cutouts surrounding the portions corresponding to the overlapping portions.

14. The thermally actuated switch according to claim 13, wherein each of the die surfaces is formed such that, when the die surfaces sandwich and press the thermally actuated plate, corner portions, sandwiched between outer circumferences of the circular dish-shaped surfaces and the arcs of the cutouts, are located between the overlapping portions and the widthwise sides of the thermally actuated plate.

15. The thermally actuated switch according to claim 14, wherein when the die surfaces sandwich and press the thermally actuated plate, front ends of the corner portions of the thermally actuated plate are shifted in the longitudinal direction thereof toward the overlapping portions and reach a position corresponding to half of a diameter of the overlapping portions.

* * * * *